US005413304A

United States Patent [19]

Kato

[11] Patent Number: 5,413,304

[45] Date of Patent: May 9, 1995

[54] APPARATUS FOR SUPPORTING COIL MATERIAL SUPPLY DEVICE

[75] Inventor: Heizaburo Kato, Shizuoka, Japan

[73] Assignee: Sankyo Seisakusho Co., Tokyo, Japan

[21] Appl. No.: 149,465

[22] Filed: Nov. 9, 1993

[51] Int. Cl.[6] ..... F16M 13/00

[52] U.S. Cl. ..... 248/421; 72/183; 242/564.4

[58] Field of Search ..... 248/421; 492/1; 242/78.6, 75.51, 75.45, 75.3; 72/417, 428, 183, 43, 164

[56] References Cited

U.S. PATENT DOCUMENTS

| | | | |
|---|---|---|---|
| 3,687,391 | 8/1972 | Bournez | 242/79 |
| 3,780,561 | 12/1973 | Ames | 72/417 |
| 4,387,876 | 6/1983 | Nathan | 248/421 X |
| 4,549,422 | 10/1985 | Harrow | 72/183 X |
| 4,567,630 | 2/1986 | Ishida | 72/183 X |
| 4,608,844 | 9/1986 | Lehmann | 72/43 |
| 4,823,582 | 4/1989 | Bourbon | 72/164 |
| 4,953,808 | 9/1990 | Craycraft | 242/78.6 |

FOREIGN PATENT DOCUMENTS

| | | | |
|---|---|---|---|
| 171533 | 10/1982 | Japan | 72/183 |

*Primary Examiner*—J. Franklin Foss
*Attorney, Agent, or Firm*—Darby & Darby

[57] ABSTRACT

A support apparatus for a coil material supply device includes first and second arms pivotally mounted at their proximal end portions on a frame by respective pins, a third arm which has distal end portions of the first and second arms pivotally supported thereon by respective pins, and also has the coil material supply device mounted on an upper end thereof, first and second length adjustment devices for adjusting the lengths of the first and second arms, respectively, and a rotating device for pivotally moving the first arm to adjust the angle of pivotal movement of the first arm. With this construction, the position of the coil material supply device with respect to an intermittent feed device of a mechanical press can be freely adjusted to set the optimum feed condition.

5 Claims, 6 Drawing Sheets

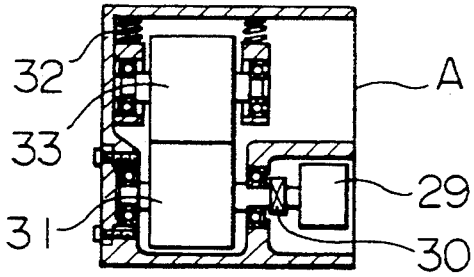
FIG. 2
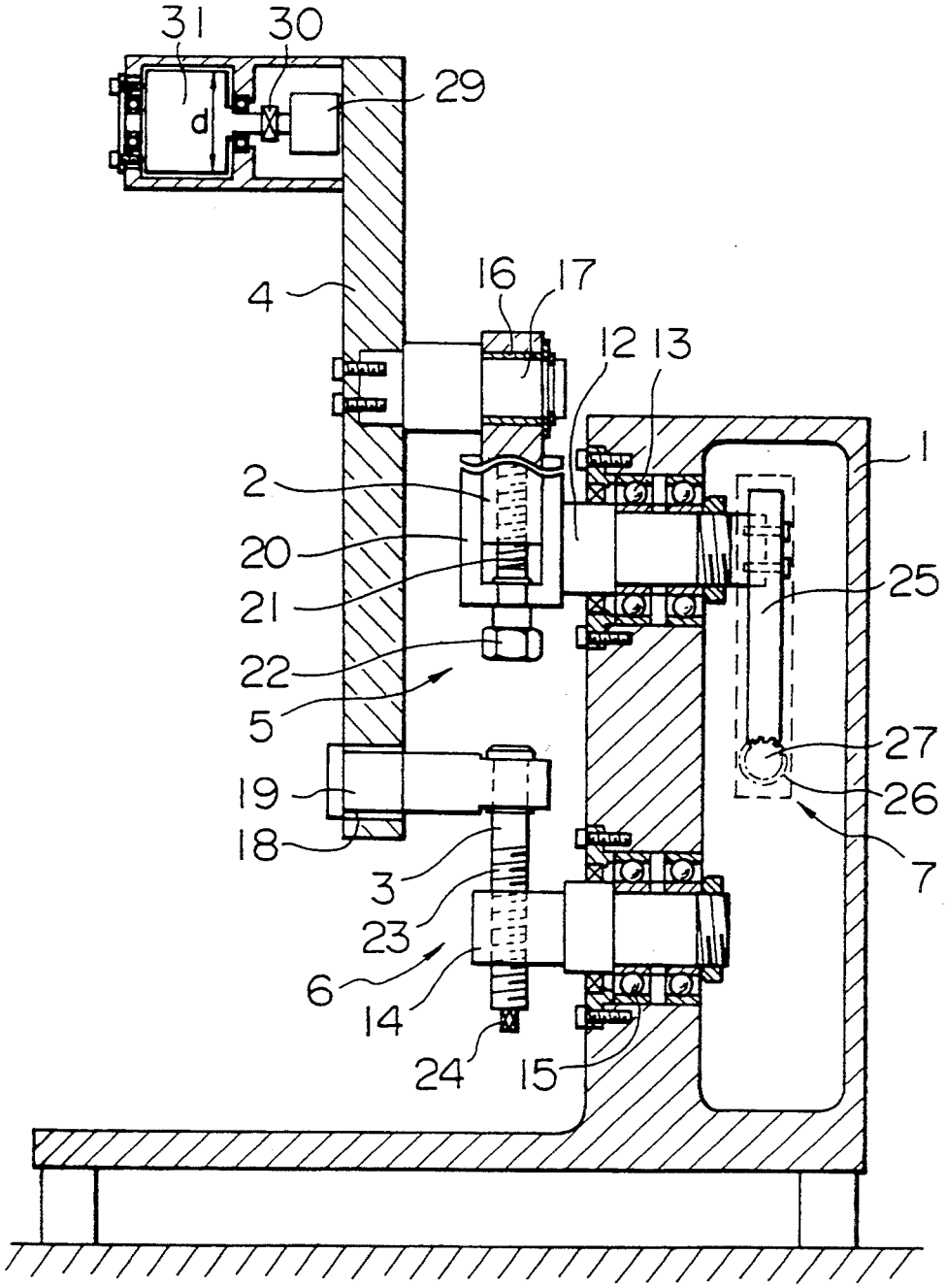

APPARATUS FOR SUPPORTING COIL MATERIAL SUPPLY DEVICE

BACKGROUND OF THE INVENTION

This invention relates to apparatus for supporting a coil material supply device used in a pressing line.

With a high-speed pressing operation, the time used for intermittently feeding a coil material has become short, and the coil material is repeatedly fed and stopped in such a short time. As a result, the coil material vibrates by an exciting force exerted thereon, so that a wavy phenomenon called "fluttering" occurs. When such fluttering of the coil material occurs, not only an excessive burden or load is imposed on a feed device, but also the coil material is bent or damaged. To prevent this, it has been proposed to provide a buffer section called "looper" at the coil material.

FIG. 6 shows a U-shaped looper, and that portion of a coil material 101 lying between an uncoiler 102 for unwinding the coil material 101 and an intermittent feed device 104 mounted on a mechanical press 103 has a U-shaped buffer section. FIG. 7 shows an S-shaped looper, and that portion of a coil material 101 lying between an uncoiler 102 for unwinding the coil material 101 and an intermittent feed device 104 mounted on a mechanical press 103 has an S-shaped buffer section.

In such a pressing line, various kinds of coil materials having different physical properties and shapes are used, and a feed pitch often need to be changed, and the operation speed often need to be changed, for example, into a higher speed. In such a case, taking into consideration the degree of bending of the coil material, as well as the alleviation of the influence of an inertial mass and an inertia force, the optimum condition for the coil material supply device must be set or determined depending on the above various changes.

With the coil material supply device utilizing the conventional U-shaped looper or S-shaped looper, however, the following problems have been encountered:

(1) The positional relation of the coil material supply device to the intermittent feed device is determined by the position of installation of this supply device, and is basically fixed. Therefore, it has been difficult to vary the position in accordance with a change of the feed condition.

(2) The position of guides or rollers of the coil material supply device is determined by an initial setting, and therefore it has been difficult to exchange the guides with other guides of a different shape, or to change the position of the rollers in accordance with a change of the feed condition.

(3) The condition of setting of the U-shaped looper or the S-shaped looper can not be changed during the operation of the pressing line, and therefore it has been difficult to find the optimum condition for the coil material supply device.

SUMMARY OF THE INVENTION

With the above problems of the prior art in view, it is an object of this invention to provide apparatus for supporting a coil material supply device which can freely change the position of the coil material supply device, and can set the optimum feed condition.

According to the present invention, there is provided apparatus for supporting a coil material supply device adapted to feed a coil material to an intermittent feed device of a mechanical press, comprising:

a first arm pivotally mounted at its proximal end portion on a frame;

a second arm pivotally mounted at its proximal end portion on the frame;

a third arm pivotally supported on distal end portions of the first and second arms, the coil material supply device being adapted to be mounted on an upper end portion of the third arm;

first and second length adjustment means for adjusting the lengths of the first and second arms, respectively; and rotating means for pivotally moving the first arm to adjust the angle of pivotal movement of the first arm.

Therefore, in the present invention, by adjusting the lengths of the first and second arms by the respective length adjustment means, and by adjusting the angle of pivotal movement of the first arm by the rotating means, the position of the coil material supply device, mounted on the upper end portion of the third arm, with respect to the intermittent feed device can be freely changed, thereby setting the optimum feed condition. And besides, the optimum condition for the coil material supply device can be found even during the operation of the pressing line.

BRIEF DESCRIPTION OF THE DRAWINGS

FIG. 2 is a schematic, cross-sectional, side-elevational view of the support apparatus of FIG. 1;

DESCRIPTION OF THE PREFERRED EMBODIMENT

Figure 1:
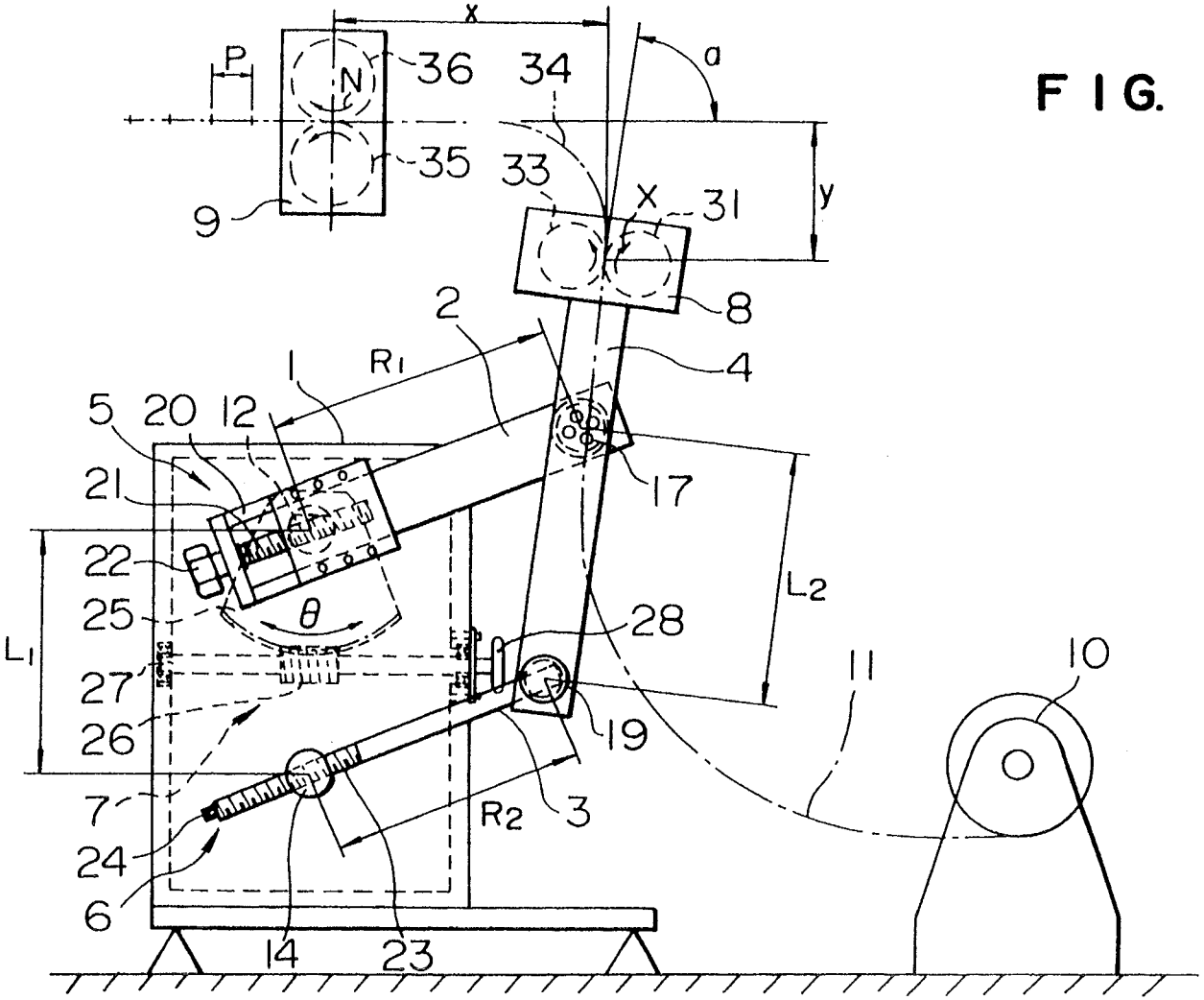
FIG. 1 is a front-elevational view of apparatus for supporting a coil material supply device, provided accordance with the present invention.

FIG. 1 is a front-elevational view of a support apparatus for a coil material supply device, embodying the present invention, and FIG. 2 is a schematic, cross-sectional, side-elevational view thereof. The support apparatus comprises a frame 1, a first arm 2, a second arm 3, a third arm 4, a length adjustment means 5 provided on the first arm 2, a length adjustment means 6 provided on the second arm 3, and a rotating (drive) means 7 provided on the first arm 2. The coil material supply device 8 is mounted on an upper end of the third arm 4, and an intermittent feed device 9 is associated with a mechanical press. A coil material 11 is unwound by an uncoiler 10, and is fed to the coil material supply device 8.

The first arm 2 is pivotally mounted at its proximal end portion on the frame 1 by a support pin 12 through bearings 13. The second arm 3 is pivotally mounted at its proximal end portion on the frame 1 by a support pin 14 through bearings 15. The support pins 12 and 14 are spaced from each other in a vertical direction, and the distance between the two support pins 12 and 14 (that is, between the axes of these pins) is $L_1$. The distal end portion of the first arm 2 is pivotally connected to the third arm 4 by a support pin 17 through a bearing 16. The distal end portion of the second arm 3 is pivotally connected to the third arm 4 by a support pin 19 through a bearing 18. The distance between the support pins 17 and 19 (that is, the axes of these pins) is $L_2$. The distance between the support pins 12 and 17 on the first arm 2 is $R_1$, and the distance between the support pins 14 and 19 on the second arm 3 is $R_2$.

The first arm 2 has a rectangular cross-section, and its proximal end portion is slidably fitted in a slide guide 20 to which the support pin 12 is fixedly secured, and a length adjustment screw 21 is threaded into the proximal end portion of the first arm 2. By rotating a nut portion 22 of the screw 21, the first arm 2 is caused to slide relative to the slide guide 20, so that the length of the first arm 2, that is, the distance $R_1$ between the support pins 12 and 17, is adjusted. The length adjustment means 5 is constituted by these parts.

The second arm 3 has a circular cross-section, and has a length adjustment thread 23 formed on the proximal end portion thereof, the length adjustment thread 23 being extended through and threadedly engaged with the support pin 14 which is rotatable about its axis. By rotating a nut portion 24 of the second arm 3, the length of the second arm 3, that is, the distance $R_2$ between the support pins 14 and 19 is adjusted. The length adjustment means 6 is constituted by these parts.

A sector gear 25 is fixedly mounted on one end portion of the support pin 12 (which pivotally supports the proximal end portion of the first arm 2) remote from the slide guide 20, and teeth of the sector gear 25 is in mesh with a worm gear 26. The worm gear 26 is fixedly mounted on a rotation shaft 27 mounted horizontally on the frame 1, and a handle 28 is fixedly mounted on one end portion of the rotation shaft 27 disposed exteriorly of the frame 1. By rotating the handle 28, the sector gear 25 is angularly moved through the worm gear 26 to adjust the angle $\theta$ of pivotal movement of the first arm 2. The rotating (drive) means 7 is constituted by these parts.

The operation of the above embodiment will now be described. The coil material 11 unwound from the uncoiler 10 is fed toward the coil material supply device 8 mounted on the upper end of the third arm 4. As shown at a portion A of FIG. 2, the coil material supply device 8 includes a drive roll 31 driven by a servomotor 29 through a coupling 30, an idle roll 33 urged by springs 32 against the drive roll 31 for rotation therewith. The coil material 11 is fed through the drive roll 31 and the idle roll 33, and then is formed into a loop 34, and further is fed to the mechanical press through the intermittent feed device 9 having a pair of rolls 35 and 36 which are rotated in synchronism with the rotation of a crankshaft of the mechanical press.

Here, the crankshaft of the mechanical press is operated at a rotational angle N, and the coil material 11 is intermittently fed at a feed pitch P per revolution of the crankshaft. Therefore, the coil material 11 is fed an amount or length ($N \times P$) per unit time. The angle X of rotation of the drive feed roll 31 is expressed by the following formula:

$$X = N \times P / d\pi \pm \alpha$$

where d represents the diameter of the drive feed roll 31, and $\alpha$ represents a correction rotation amount for keeping the loop 34 to a proper configuration.

When the loop 34 formed by the coil material supply device 8 becomes too large, a sensor detects this to output a detection signal, and in response to this signal, a controller controls the number of revolution of the servomotor 29, so that the rotation angle X of the drive roll 31 is decreased by an amount $\alpha$ to reduce the amount of feed of the coil material 11, thereby bringing the loop 34 into the proper configuration. In contrast, when the loop 34 becomes too small, the rotation angle X of the drive roll 31 is increased by an amount $\alpha$ to increase the amount of feed of the coil material 11, thereby bringing the loop 34 into the proper configuration.

Figure 3:
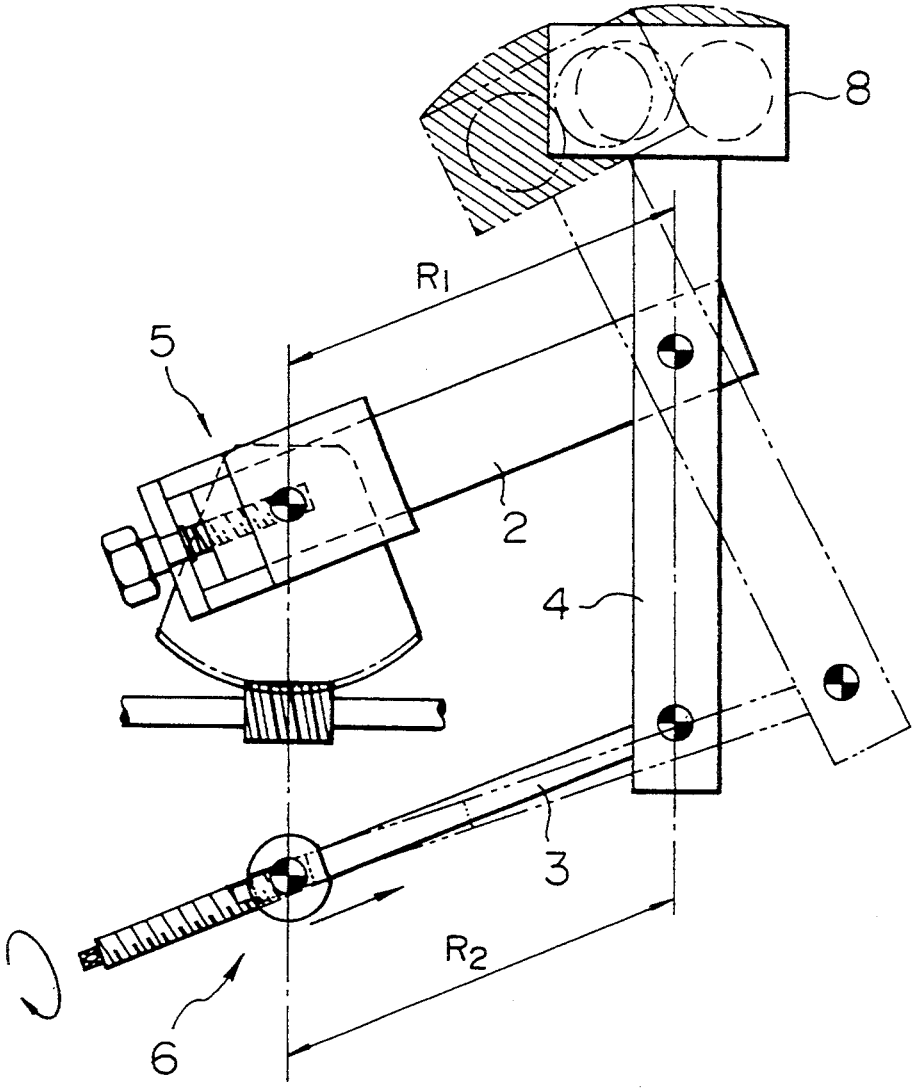
FIGS. 3 to 5 are views explanatory of the operation of the support apparatus.
Figure 4:
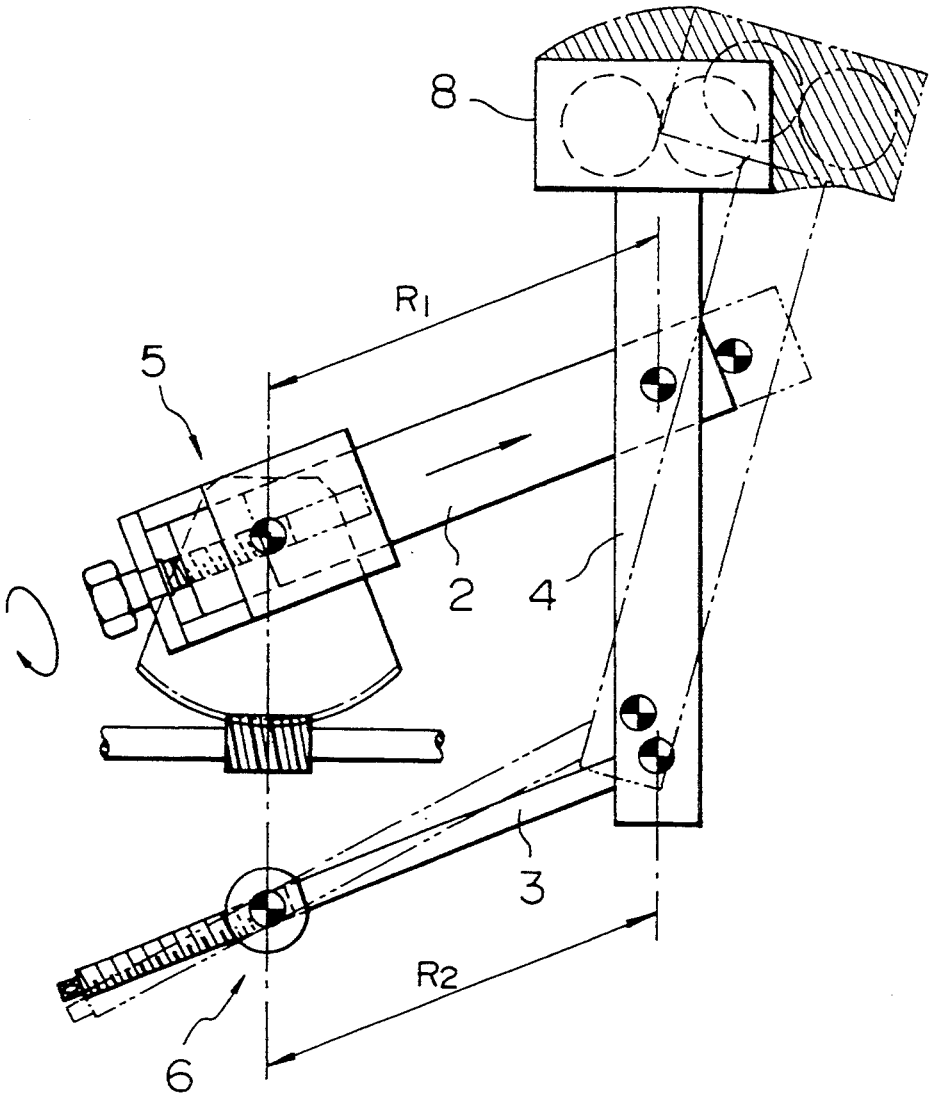
Figure 5:
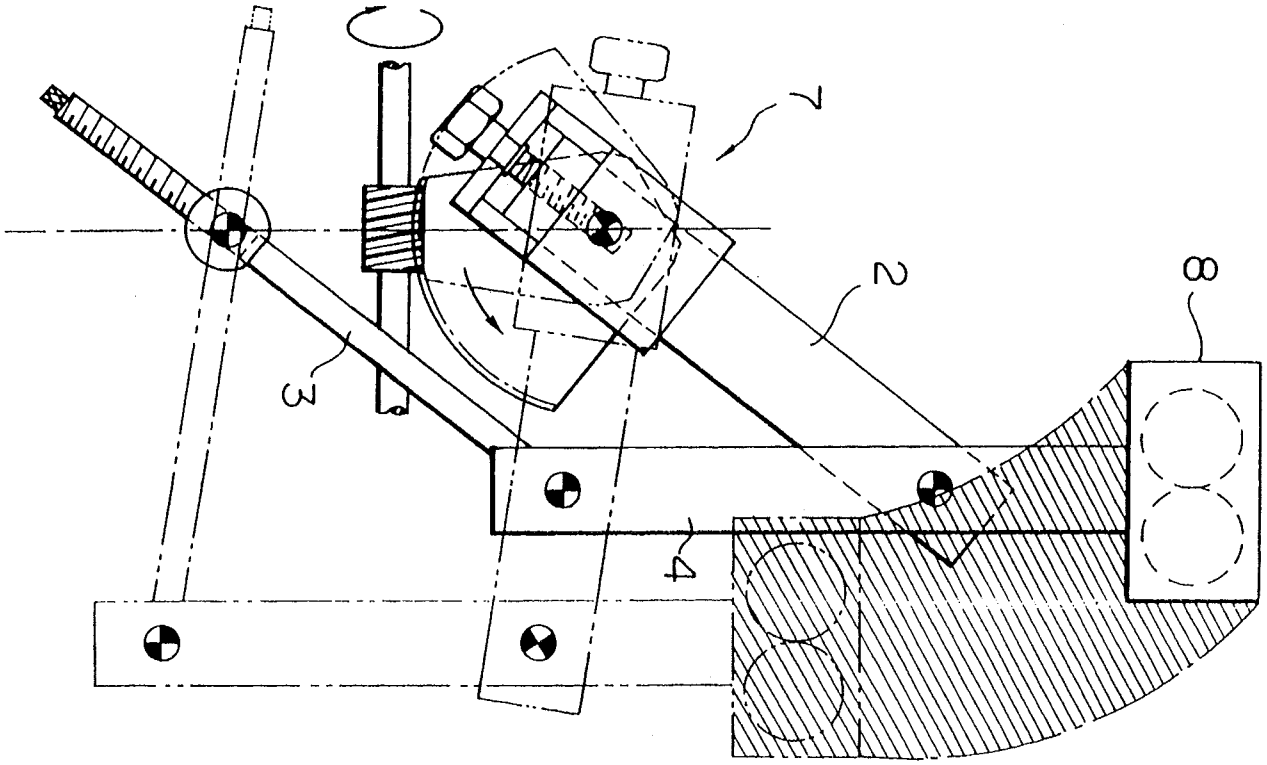
Figure 6:
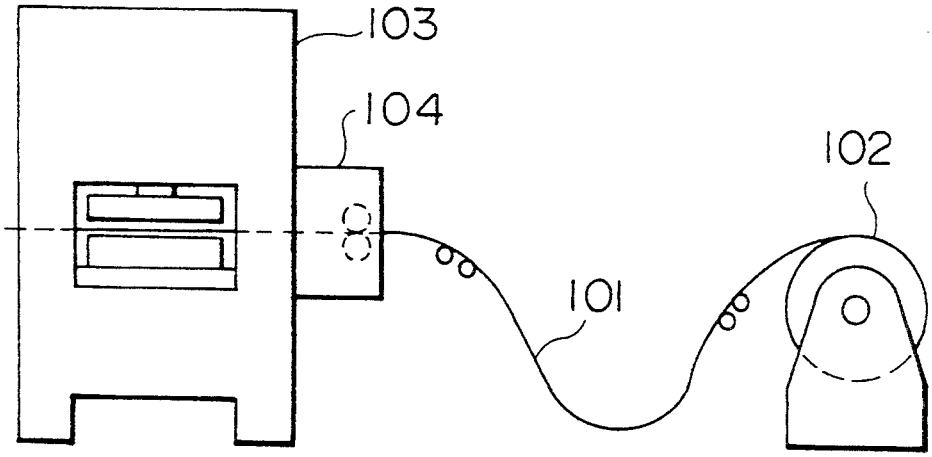
FIG. 6 PRIOR ART
FIG. 6 is a schematic view of the conventional pressing line.
Figure 7:
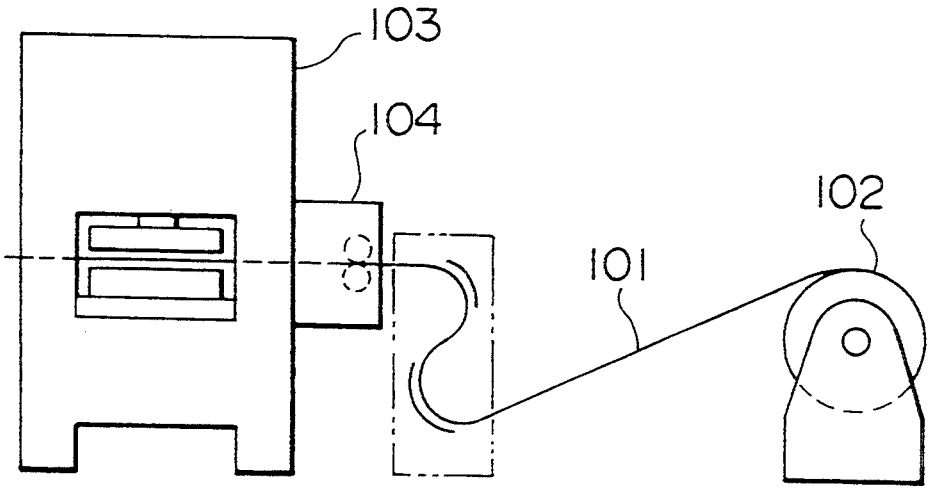
FIG. 7 PRIOR ART
FIG. 7 is a schematic view of another conventional pressing line.

The position of the coil material supply device 8 with respect to the intermittent feed device 9 is adjusted in various ways. For example, when it is desired to bring the coil material supply device 8 closer to the intermittent feed device 9, the length of the second arm 3, that is, the distance $R_2$ between the support pins 14 and 19, is increased by the length adjustment means 6, or the distance $R_1$ between the support pins 12 and 17 on the first arm 2 is decreased by the length adjustment means 5, as shown in FIG. 3. In contrast, for bringing the coil material supply device 8 away from the intermittent feed device 9, the length of the first arm 2, that is, the distance $R_1$ between the support pins 12 and 17, is increased is increased by the length adjustment means 5, or the distance $R_2$ between the support pins on the second arm 3 is decreased, as shown in FIG. 4. For bringing the coil material supply device 8 to a higher position, the first arm 2 is pivotally moved counterclockwise by the rotating means 7 as shown in FIG. 5. In contrast, for bringing the coil material supply device 8 to a lower position, the first arm 2 is pivotally moved clockwise by the rotating means 7.

Thus, by adjusting the distance $R_1$ between the support pins on the first arm 2, the distance $R_2$ between the support pins on the second arm 3, and the angle $\theta$ of pivotal movement of the first arm 2, a horizontal distance x between the coil material supply device 8 and the intermittent feed device 9, a vertical distance y between the rolls of the coil material supply device 8 and the rolls of the intermittent feed device 9, and an angle a between the direction of feed by the coil material supply device 8 and the direction of feed by the intermittent feed device 9 can be freely set or adjusted.

As described above, the support apparatus of the present invention comprises the first and second arms pivotally mounted at their proximal end portions on the frame, the third arm which is pivotally supported on distal end portions of the first and second arms, and has the coil material supply device mounted on the upper end portion of the third arm, the length adjustment means for adjusting the lengths of the first and second arms, respectively, and the rotating means for pivotally moving the first arm to adjust the angle of pivotal movement of the first arm. Therefore, by adjusting the lengths of the first and second arms, and by adjusting the angle of pivotal movement of the first arm, the position of the coil material supply device, mounted on the upper end portion of the third arm, with respect to the intermittent feed device can be freely changed, thereby setting the optimum feed condition. And besides, the optimum condition for the coil material supply device can be found even during the operation of the pressing line.

What is claimed is:

1. Apparatus for supporting a coil material supply device adapted to feed a coil material to an intermittent feed device of a mechanical press, comprising:

a first arm pivotally mounted at its proximal end portion on a frame;

a second arm pivotally mounted at its proximal end portion on the frame;

a third arm pivotally supported on distal end portions of said first and second arms, said coil material supply device being adapted to be mounted on an upper end portion of said third arm;

first and second length adjustment means for adjusting the lengths of said first and second arms, respectively; and rotating means for pivotally moving said first arm to adjust the angle of pivotal movement of said first arm.

2. Apparatus according to claim 1, in which said first arm is pivotally connected at its distal end portion to said third arm intermediate opposite ends of said third arm, and said second arm is pivotally connected at its distal end portion to a lower end portion of said third arm.

3. Apparatus according to claim 1, in which said first length adjustment means comprises a slide guide of a tubular shape into which the proximal end portion of said first arm is slidably received, and a length adjustment screw threaded into the proximal end portion of said first arm, said slide guide being pivotally mounted on the frame, wherein by rotating said length adjustment screw, said first arm is slidingly moved axially relative to said slide guide, thereby adjusting the length of said first arm.

4. Apparatus according to claim 1, in which said second length adjustment means comprises a threaded portion formed on the proximal end portion of said second arm, and a pin mounted on the frame for rotation about an axis of said pin, said threaded portion on said second arm being threadedly engaged with said pin, wherein by rotating said second arm about its axis, said second arm is axially moved through the threaded engagement of said threaded portion with said pin, thereby adjusting the length of said second arm.

5. Apparatus according to claim 1, in which said rotating means comprises a sector gear fixedly connected to said proximal end portion of said first arm, a rotation shaft mounted the frame for rotation about an axis of said rotation shaft, and a worm gear fixedly mounted on said rotation shaft, said sector gear being in mesh with said worm gear, wherein by rotating said rotation shaft, said sector gear is angularly moved through said worm gear, thereby pivotally moving said first gear.

* * * * *